US011732964B2

(12) United States Patent
Patel et al.

(10) Patent No.: US 11,732,964 B2
(45) Date of Patent: Aug. 22, 2023

(54) LYOPHILIZATION PROMOTING ELEMENT

(71) Applicant: Navinta III Inc, Boca Raton, FL (US)

(72) Inventors: Mahendra R. Patel, Delray Beach, FL (US); Sandipkumar Arvindbhai Patel, Robbinsville, NJ (US)

(73) Assignee: Navinta III Inc, Boca Raton, FL (US)

( * ) Notice: Subject to any disclaimer, the term of this patent is extended or adjusted under 35 U.S.C. 154(b) by 197 days.

(21) Appl. No.: 17/230,843

(22) Filed: Apr. 14, 2021

(65) Prior Publication Data

US 2021/0325110 A1 Oct. 21, 2021

Related U.S. Application Data

(60) Provisional application No. 63/010,283, filed on Apr. 15, 2020.

(51) Int. Cl.
*F26B 5/06* (2006.01)

(52) U.S. Cl.
CPC ..... *F26B 5/06* (2013.01)

(58) Field of Classification Search
CPC ..... F26B 5/06
USPC ..... 34/237, 92
See application file for complete search history.

(56) References Cited

U.S. PATENT DOCUMENTS 4,001,944 A 1/1977 Williams
5,522,155 A * 6/1996 Jones ..... B65D 51/1683 34/286
5,937,536 A * 8/1999 Kieselbach ..... F26B 5/044 34/92
6,419,827 B1 7/2002 Sandell et al.
8,516,714 B2 * 8/2013 Biemans ..... A61K 9/19 62/50.7

(Continued)

FOREIGN PATENT DOCUMENTS

AU 2016208368 B2 5/2019
CN 106461327 B 12/2019

(Continued)

OTHER PUBLICATIONS

Barron, Randall F. and Brian R. Barron. Design for Thermal Stresses. John Wiley & Sons, Inc. 2012. [Retrieved Jun. 18, 2021). Retrieved from the internet: <URL: https://onlinelibrary.wiley.com/doi/pdf/10.1002/97811 18093184.app2> Appendix B.

(Continued)

*Primary Examiner* — Stephen M Gravini
(74) *Attorney, Agent, or Firm* — St. Onge Steward Johnston & Reens LLC

(57) ABSTRACT

A lyophilization promoting element to facilitate the transfer of heat between a lyophilizer and a pre-lyophilization solution. The element includes a base plate with a plurality of apertures. The base plate is made of a thermally conductive material and the apertures are regularly arranged within the base plate, each aperture being sized to receive a pharmaceutical vial container containing a pre-lyophilization solution. A method of lyophilizing includes inserting one or more pharmaceutical vial containers into the plurality of apertures of the lyophilization promoting element and placing the lyophilization promoting element holding the one or more pharmaceutical vial containers on a shelf of a lyophilizer.

18 Claims, 10 Drawing Sheets

(56) References Cited

U.S. PATENT DOCUMENTS

| | | | | |
|---|---|---|---|---|
| 8,528,225 | B2 * | 9/2013 | Weisselberg | A23L 3/44 202/109 |
| 8,793,896 | B2 * | 8/2014 | Patel | F26B 5/06 422/186.04 |
| 9,522,752 | B2 * | 12/2016 | Wissner | F26B 5/06 |
| 10,085,971 | B2 * | 10/2018 | Patel | A61P 25/18 |
| 10,342,769 | B2 * | 7/2019 | Patel | A61P 25/00 |
| 10,781,003 | B2 | 9/2020 | Procyshyn et al. | |
| 10,869,848 | B2 * | 12/2020 | Patel | A61K 31/175 |
| 11,054,185 | B1 * | 7/2021 | Trappler et al. | F26B 25/185 |
| 11,243,029 | B2 * | 2/2022 | Strongrich | F26B 25/22 |
| 11,359,860 | B2 * | 6/2022 | McNeil | C11B 1/10 |
| 11,377,276 | B2 * | 7/2022 | Mueller | F26B 5/06 |
| 2013/0025298 | A1 | 1/2013 | Schryver | |
| 2015/0108034 | A1 | 4/2015 | Deutschle et al. | |
| 2018/0148222 | A1 | 5/2018 | Deutschle et al. | |
| 2019/0285342 | A1 | 9/2019 | Thompson et al. | |
| 2021/0325110 | A1 * | 10/2021 | Patel | F26B 25/063 |

FOREIGN PATENT DOCUMENTS

| | | | | |
|---|---|---|---|---|
| CN | 110180607 | B | 8/2020 | |
| EP | 3499160 | A1 | 6/2019 | |
| EP | 3494349 | B1 * | 10/2020 | B65D 45/16 |
| JP | 6944991 | B2 * | 10/2021 | B65D 45/16 |
| KR | 20150009982 | A * | 1/2015 | |
| WO | WO-2017137637 | A2 * | 8/2017 | B65D 45/16 |

OTHER PUBLICATIONS

International Search Report & Written Opinion of the International Searching Authority Application No. PCT/US2021/027435 Completed: Jun. 18, 2021; dated Aug. 13, 2021 15 pages.

Shah, Ramesh K. and Dusan P. Sekulic. Fundamentals of Heat Exchanger Design. John Wiley & Sons, Inc. 2003. [Retrieved Jun. 18, 2021). Retrieved from the internet: <URL: https://onlinelibrary.wiley.com/doi/pdf/10.1002/9780470172605.app1> Appendix A.

Von Graberg. Freeze Drying from Small Containers: Heat and Mass Transfer and Implications on Process Design. Friedrich-Alexander-University Er1angen-Nurnberg. Jul. 28, 2011 (Jul. 28, 2011 ) [Retrieved Jun. 18, 2010 ]. Retrieved from the internet: <URL: https://opus4.kobv.de/opus4-fau/frontdoor/index/index/docld/1882> pp. 5, 6, 40-44.

Catalent Biologies website; "Vial Filling & Lyophilization"; downloaded from internet on Apr. 14, 2021. https://biologics.catalent.com/biologics/drug-product/vial-filling-lyophilization/.

Graberg S, Hyla W, Gieseler H. Freeze Drying from small product containers to its implication on freeze-drying process design: evaluation of heat transfer coefficient of a new 96-well freeze drying system in comparison to 2R tubing vials and polypropylene 96-well PCR-plates. CPPR Freeze Drying of Pharmaceuticals and Biologicals. Breckenridge, Colorado; 2008.

Levenspiel, O., 2014. Engineering Flow and Heat Exchange. 3rd ed. Corvallis: Springer, p. 179.

Patel, S. and Pikal, M., 2010. Freeze-Drying in Novel Container System: Characterization of Heat and Mass Transfer in Glass Syringes. Journal of Pharmaceutical Sciences, 99(7), pp. 3188-3204.

Pikal, M., Bogner, R., Mudhivarthi, V., Sharma, P. and Sane, P., 2016. Freeze-Drying Process Development and Scale-Up: Scale-Up of Edge Vial Versus Center Vial Heat Transfer Coefficients, K v. Journal of Pharmaceutical Sciences, 105(11), pp. 3333-3343.

Rambhatla, S. and Pikal, M., 2003. Heat and mass transfer scale-up issues during freeze-drying, I: Atypical radiation and the edge vial effect. AAPS PharmSciTech, 4(2), pp. 22-23.

Werk, T., Ludwig, I., Luernkemann, J., Huwyler, J., Mahler, H., Haeuser, C. and Hafner, M., 2016. New Processes for Freeze-Drying in Dual-Chamber Systems. PDA Journal of Pharmaceutical Science and Technology, 70(3), pp. 191-207.

* cited by examiner

LYOPHILIZATION PROMOTING ELEMENT

FIELD OF THE INVENTION

The present invention relates to pharmaceutical lyophilization manufacturing processes and lyophilized products. In particular, the present invention relates to a system and method of use for a lyophilization promoting element.

BACKGROUND OF THE INVENTION

Over the past several decades, freeze drying, or lyophilization, has become an important technology to achieve short and long term storage stability for delicate pharmaceuticals. This drying procedure is the method of choice for all active pharmaceutical ingredients (APIs) which are prone to degradation or inactivation in solution or at temperatures higher than ambient. Products such as these are typically distributed in final packaging as a lyophilized powder in a vial and with separate syringes; the powder is reconstituted with a diluent prior to administration and then injected using the syringe. The Pfizer-BioNTech COVID-19 vaccine is a recent example of a product that is manufactured using lyophilization.

Lyophilization involves the removal of water or other solvents from a given product by a process called sublimation. This occurs when the ice of a frozen product converts directly to the gaseous state without passing through the liquid phase. In a typical lyophilization process, non-sterile solids are dissolved in solvent to form a solution. The solution is then aseptically filtered through a 0.2μ sterile grade filter. The filtered solution is filled into a suitable glass container with partial stoppering. Partially stoppered containers are then loaded in a lyophilizer chamber.

Vials are often prepared and tightly packed on a tray, which is typically slid out from under the vials after they are loaded on a shelf in the freeze dryer so that the vial bottoms have direct contact with the shelf. In a lab setting, vials of product solution are often wrapped with a band (e.g., steel) and placed on a dryer shelf. The system may be referred to as a "bottomless tray" system. In auto-loading systems used in some manufacturing plants, vials are loaded directly onto the shelves without the use of trays, although the shelves may have a "ridge" at the edge to prevent vials from falling off the shelf.

Lyophilization is performed in three consecutive steps by controlling the temperature of shelves (where the containers are loaded) and the pressure of chamber. These steps are freezing, primary drying, and secondary drying. Lyophilized containers are then fully stoppered and sealed.

Commercial lyophilizers for the pharmaceutical industry are designed to control temperature of a product by using circulating fluid inside the shelves on which the containers are placed. Desired temperature of the product solution can be achieved by controlling the temperature of the circulating fluid. Heat is transferred from the circulating fluid to the shelf, to the container, and then to the product solution during the primary and secondary drying, while reverse in freezing. The temperature of the product solution is reduced during the freezing process and increased during the primary and the secondary drying. Chamber pressure is reduced (creating vacuum) during the primary and the secondary drying to promote sublimation of frozen material.

In general, heat flows from one place to another place by three distinct mechanisms:

By conduction, or the transfer of energy from matter to adjacent matter by direct contact, without intermixing or flow of any material. Conduction refers to the transfer of heat from the hotter to the colder part of a body by direct molecular contact, not by gross movement of clumps of hot material to the cold region.

By convection, or the transfer of energy by the bulk mixing of clumps of material. In natural convection it is the difference in density of hot and cold fluid which causes the mixing. In forced convection a mechanical agitator or an externally imposed pressure difference (by fan or compressor) causes the mixing.

By radiation such as light, infrared, ultraviolet, and radio waves which emanate from a hot body and are absorbed by a cooler body.

During freezing and drying steps in lyophilization, heat is transferred from or to the solution in three mechanisms of heat transfer, i.e., direct conduction, gas conduction and radiation. Conduction occurs from metal shelves to glass vials, and from surrounding gas molecules to glass vials and solutions, while radiation occurs from surroundings to glass vials in the form of radiant heat. Heat transfer occurs also by means of radiation from a top shelf directly to the solution as shown in FIG. 1.

Direct conduction occurs only from a shelf to the bottom of a vial; gas conduction occurs by means of gas molecules in air; while radiation occurs from all directions. It is generally understood that, in a lyophilization process, the amount of heat transferred via radiation is significantly less than conduction. Gas conduction is greater at higher pressure and less in lower pressure.

In a typical lyophilization process, during primary drying, vacuum is applied, and temperature is increased above the freezing temperature to promote sublimation. However, the temperature should be lower than the glass transition temperature (known as Tg) to avoid melt back or collapse in product. It is very important to achieve homogenous temperature throughout the shelves in all vials to achieve desired and consistent quality in product vials. Uniformity in heating during primary drying and secondary drying reduces vial to vial variability of residual solvent due to minimum variation in heat transfer.

During primary drying, atypical radiation effects arise from the walls to the door of the dryer that run at a higher temperature than the shelf set point. Atypical radiation heat transfer experienced by edge vials because of their clear view of a warmer surface is responsible for their higher heat transfer rates. It is known in the art that this effect can be minimized by the use of suitable radiation shields.

Additionally, edge vials, shown in FIG. 2, have a different heat transfer co-efficient than the center vials, which can cause variation in heat transfer and vial to vial variability. Vials near to the lyophilizer door will have more exposure to radiant heat coming from the door. This will cause faster drying or potential collapse in vials near to the door due to higher product temperature.

Thus, known issues in a lyophilization process are an inefficient or nonuniform heat transfer from shelf to vials resulting into vial to vial variability in dryness of product, and collapse or melt back of cake in some areas of lyophilizer due to higher heat exposure and higher residual solvent level due to lower heat transfer. Vial transfer from the filling line to a lyophilizer shelf is also a challenge that ultimately impacts product yield and poses a high risk of contamination due to vial fall down and spillage of product solution online. Moreover, tracking of an individual vial within a tray is difficult, as all vials are mixed up in the tray and it is difficult to locate the vial position on a shelf of a lyophilizer.

Another issue with product prepared by lyophilization is handling of a vial after filling and loading into lyophilizer. As lyophilization is an aseptic operation, handling of filled and half stoppered vials is difficult and results in dropping of the vials online, which increases risk of contamination. The issue is even more acute while handling cytotoxic compounds or potent compounds.

In commercial manufacturing of product prepared by a lyophilization process, the location of vials in the lyophilizer shelf is very important for investigation purposes or to validate a lyophilization load and recipe. In current practice, location of a vial is traced by tray number and location, however, the tracking is difficult after visual inspection within a tray.

Systems to address some of these issues with lyophilization are known in the prior art. One system is to place the vials in a standard 96-well plastic plate, such as a polypropylene plate. This helps with spillage and identification but is still susceptible to atypical edge vial effect. There have been reports of modifying such systems to be constructed of or contained in aluminum blocks.

VirTis developed a 96-well freeze-drying system, which consists of glass or plastic vials placed in a specially designed aluminum block for uniform heat transfer, which claims to eliminate the atypical edge vial effect seen in standard 96-well plastic plates. The primary purpose is said to be to hold the tubes upright in the metal block and uniformly transfer. Lyocap 96-well capmat stoppers with slots are used to stopper the wells either under vacuum or inert gas. The tubes have a fill volume of 0.5 mL, a tube-like shape, and a flat bottom. The tubes are inserted into black painted aluminum blocks which have precision drillings adjusted to the shape and size of the glass tubes. The blocks consist of a base plate (area of 127 mm×85 mm, height of approx. 6 mm) and an inner, higher section, which contains the bore holes. The measurements of this inner section are 120 mm×79 mm with a height (without the base plate) of 13 mm. The bore holes have a depth of 15 mm, so that the thickness of the aluminum at the bottom of a drill hole corresponds to approximately 4 mm. However, due to a bottom aluminum sheet, the vials are not directly in contact with the shelf. Aluminum between vial and shelf poses resistance to heat transfer. Moreover, this system requires use of the special tubes and stoppers.

Graberg S, Hyla W, Gieseler H., Freeze Drying from small product containers to its implication on freeze-drying process design: evaluation of heat transfer coefficient of a new 96-well freeze drying system in comparison to 2R tubing vials and polypropylene 96-well PCR-plates. CPPR Freeze Drying of Pharmaceuticals and Biologicals (2008) reported on the heat transfer coefficient for freeze-drying in a 96-well polymerase chain reaction (PCR) characterized with and without a custom-made slightly oxidized aluminum block. The contact area of 96-well plates inserted into aluminum-blocks was very heterogeneous from one well to the next and ranged from almost no contact (0%) to over 90% of contact. A tendency to better contact for wells in edge rows was noted. Most wells showed partial contact to the block cavities. The average ratio of contact area to outer well area immersed in the aluminum-block cavity was estimated to be 25%.

Another system is to simply put the vials in a corrugated aluminum "quilt." D. Patel, B. Gupta, and S. H. Yalkowsky, Acceleration of heat transfer in vial freezedrying of pharmaceuticals. I: Corrugated aluminium quilt. Journal of Parenteral Science and Technology, 43(1):8-14, 1989. However, if there are gaps between the metal surfaces and vial wall, heat transfer will only occur by conduction and radiation.

Yalkowski et al. designed a fluid filled cushion of about 1 mm thickness. The soft bag was fabricated from two sheets of aluminium foil lined with polyethylene which were welded by heat. Before the final seal was placed, the bag was filled with glycerine and degassed. This cushion was placed on the freeze dryer shelf and the vials were set on top of it. Since the cushion was flexible the vials "sank in" with the rim of the bottom, the usual line of direct contact. The fluid cushion deformed to fit to the contour of the vial bottom. To maximise contact, Yalkowski and his co-workers applied additional force in the form of an aluminium plate with holes. The holes were placed over the vials' necks. This perforated plate was held in place with clamps fastened to an additional plate fixed underneath the shelf. Using this device, a decrease in primary drying time by over 30% and an increase (approximately 10° C.) in product temperature for molded vials were observed. However, handling of the fluid cushion device is impractical for production cycles.

Many freeze-dried products are now supplied in dual chamber syringes or cartridges. The freeze-dried product is located in one chamber and the diluent is in a second chamber. Typically, the product is freeze-dried first and then a stopper is pushed into the syringe barrel to separate the two chambers, and then the diluent is filled in the other chamber.

Werk, T., Ludwig, I., Luemkemann, J., Huwyler, J., Mahler, H., Haeuser, C. and Hafner, M., New Processes for Freeze-Drying in Dual-Chamber Systems. *PDA Journal of Pharmaceutical Science and Technology*, 70(3), pp.191-207 (2016), teach a holder system for freeze-drying in syringes, which was custom designed from an aluminum block. The aluminum block carrier system for efficient primary packaging transportation during filling and optimized heat transfer during freeze-drying was used for lyophilization in a dual chamber pre-filled syringe.

Patel, S. and Pikal, M., Freeze-Drying in Novel Container System: Characterization of Heat and Mass Transfer in Glass Syringes. *Journal of Pharmaceutical Sciences,* 99(7), pp. 3188-3204 (2010), discloses two different "holder systems" that were custom designed to hold syringes during a lyophilization process. The first one was a plexiglass holder with four support legs wherein the syringes were suspended through the holes, much as in a test tube rack. The second was an aluminum (Al) block wherein the syringes sit inside the holes (ID: 1.52 cm) drilled in the Al block. In both the holder systems, the holes were drilled in such a way so as to achieve a closest hexagonal packing array. Syringes were placed inside the holes drilled in the aluminum block, which was itself placed on the shelf. Thus, the heat transfer was: (a) from the shelf to the aluminum block and (b) from the aluminum block to the syringe. Since the aluminum block is in direct contact with the shelf, the heat is transferred from the shelf to the block by direct heat conduction, conduction through the gas that exists in the gap between the block and the shelf, and via radiation. In the plexiglass holder, the syringes did not have direct contact with the shelf as they were suspended above the shelf. Further, the separation distance between the shelf and the syringe was on the order of cm (about 10 mm), and hence there would be relatively less heat transfer via gas conduction.

Since equipment and processing costs are very high with freeze-drying, there is great economic motivation to minimize processing times. The heat and mass transfer, which in turn governs processing cost and time, depends on the container-closure system used for freeze-drying. Various products and containers will react differently to the aforementioned modifications. Thus, there is still a need for improved and varied elements for a lyophilization process that can promote the lyophilization process.

There is need for an element for a lyophilization process that reduces the variability in vials placed in different locations.

There is need for an element for a lyophilization process that significantly improves vial handling during transfer into the lyophilizer.

There is need for an element for a lyophilization process that improves heat transfer between vials and shelves of a lyophilizing chamber.

There is need for an element for a lyophilization process that improves the trackability of vials throughout manufacturing process.

It is an object of the invention to provide an element for a pharmaceutical lyophilization manufacturing process that can promote the lyophilization process, reduce variability in vials placed in different locations, and improve vial handling during transfer into a lyophilizing chamber.

It is an object of the invention to provide an element for a pharmaceutical lyophilization manufacturing process that improves the trackability of vials throughout the manufacturing process.

SUMMARY OF INVENTION

The foregoing objectives are achieved by the present invention, which relates to a system and an element for a pharmaceutical manufacturing process having a lyophilization step that improves the lyophilization step by improving heat transfer between shelves of a lyophilizing chamber and a product container in the chamber.

In a first aspect, a lyophilization promoting element is provided comprising a base plate comprising a plurality of apertures, the base plate comprising a thermally conductive material, the apertures being regularly arranged within the base plate, and each aperture being sized to receive a pharmaceutical vial container containing a pre-lyophilization solution, wherein the lyophilization promoting element facilitates the transfer of heat between a lyophilizer and the pre-lyophilization solution.

In particularly preferred embodiments, the element is capable of accommodating a 2 mL to about 100 mL container, and the container is comprised of glass, plastic, or metal.

In some embodiments, the base plate comprises a thermally conductive material with a thermal conductivity coefficient $\lambda$ of about 0.1 to about 400.0 [W/mK] at 20° C. at 1 bar and a co-efficient of linear thermal expansion $\alpha$ of about 1 to about 25 [$10^{-6}$° C.$^{-1}$] at normal temperature. In some of those embodiments, the base plate comprises aluminum or an oxide of aluminum.

In certain embodiments, the base plate comprises a hollow polymeric material and a fluid with a negative thermal expansion property.

In some embodiments, each of the plurality of apertures is cylindrical and has a diameter between 5 and 100 millimeters. In some of those embodiments, each of the plurality of apertures is cylindrical and has a diameter between 10 and 80 millimeters, most preferably about 15 mm to about 48 mm.

In certain embodiments, each of the plurality of apertures comprises a circumferential wall and is sized to allow a tolerance of no more than 0.5 millimeters between the circumferential wall and an outer wall of an inserted pharmaceutical vial container.

In some embodiments, the base plate has a vertical thickness between 10 and 200 millimeters. In some of those embodiments, the base plate has a vertical thickness between 20 and 100 millimeters.

In certain embodiments, the base plate comprises a surface area and the plurality of apertures occupy more than 50% of the surface area. In certain of those embodiments, the base plate comprises a surface area and the plurality of apertures occupy more than 80% of the surface area.

In some embodiments, at least one of the plurality of apertures extends entirely through a vertical thickness of the base plate.

In certain embodiments, at least one of the plurality of apertures extends only partially through a vertical thickness of the base plate.

In some embodiments, each of the plurality of apertures further comprises a radial groove, the radial groove expanding outwardly from a circumferential wall of each aperture adjacent to a top surface of the base plate. In some of those embodiments, each radial groove extends at an angle of approximately 45 degrees to a depth of approximately 0.5 to 10 millimeters from the top surface of the base plate down to the circumferential wall of each aperture, more preferably about 2.5 mm to about 6.5 mm.

In certain embodiments, each of the plurality of apertures extends only partially through a vertical thickness of the base plate and the base plate further comprises a plurality of protrusions extending up from the base plate into each of the plurality of apertures. In certain of those embodiments, the protrusions are sized and shaped to match an internal bore provided in a bottom of an inserted pharmaceutical vial container, said internal bore extending upwardly into an interior of said inserted pharmaceutical vial container.

In some embodiments, the base plate comprises a first portion comprised of a primary material and a second portion comprised of a secondary material, the second portion being located adjacent to a circumferential wall of each of the plurality of apertures.

In certain embodiments, each of the plurality of apertures extends entirely through a vertical thickness of the base plate and further comprises a radial ridge, the radial ridge extending inwardly from a circumferential wall of each aperture adjacent to a bottom surface of the base plate. In certain of those embodiments, each radial ridge extends at an angle of approximately 45 degrees to a height of approximately 1.5 to 4 millimeters from the bottom surface of the base plate up into each aperture to meet the circumferential wall of each aperture.

In some embodiments, each of the plurality of apertures further comprises at least one side channel that permits the passage of air, said side channel having a width no greater than 10% of a perimeter of the aperture.

In certain embodiments, each of the plurality of apertures has an associated reference number affixed to the base plate to facilitate tracking of any inserted pharmaceutical vial containers for investigatory purposes.

In a second aspect, a method of lyophilization comprises the steps of providing the lyophilization promoting element described herein, providing one or more pharmaceutical vial containers containing a pre-lyophilization solution or suspension, the one or more pharmaceutical vial containers being half stoppered, inserting the one or more pharmaceutical vial containers into the plurality of apertures of the lyophilization promoting element, placing the lyophilization promoting element holding the one or more pharmaceutical vial containers on a shelf of a lyophilizer, closing a door to the lyophilizer and initiating the lyophilization process, said lyophilization process comprising the steps of freezing, primary drying, and secondary drying, removing the lyophilization promoting element holding the one or more pharmaceutical vial containers from the lyophilizer, and fully stoppering and sealing the one or more pharmaceutical vial containers.

In some embodiments, the method further comprises the steps of providing a tray, placing the lyophilization promoting element holding the one or more pharmaceutical vial containers on the tray, placing the tray and the lyophilization promoting element holding the one or more pharmaceutical vial containers on the shelf of the lyophilizer, removing the tray from between the shelf of the lyophilizer and the lyophilization promoting element, leaving the lyophilization promoting element holding the one or more pharmaceutical vial containers on the shelf of the lyophilizer; and reinserting the tray between the lyophilizer shelf and the lyophilization promoting element and removing the tray and the lyophilization promoting element holding the one or more pharmaceutical vial containers from the lyophilizer upon completion of the lyophilization process.

A third aspect of the invention is a system to enhance thermal conduction in a freeze-drying process comprising: a lyophilizer having a plurality of shelves, and an element having one or more pockets, wherein the element is placed between a lyophilizer shelf and a sample container containing a pre-lyophilization solution.

In certain embodiments, the element has a cuboidal shape.

In some embodiments, the element is comprised of metal, alloy of metals, oxide of metals or a combination thereof.

In certain embodiments, the pockets are hollow.

In particularly preferred embodiments, the pocket is capable of accommodating a 2 mL to about 100 mL container, and the container is comprised of glass, plastic, or metal.

In some embodiments, the element is comprised of polymeric material.

In certain embodiments, the element is hollow and contains thermal conductible fluid in the hollowed portion. In certain of those embodiments, the fluid comprises water or oil. In certain embodiments, the fluid expands on cooling.

In certain embodiments, the element has radial groves within a pocket. In certain of those embodiments, a robotic filling line is used to place/fill a vial within a pocket.

In some embodiments, the one or more pockets are numbered to facilitate locating the position of vials in the lyophilizer.

In certain embodiments, the system further comprises a modified tray or shelf in the lyophilizer that has an increased surface area.

In some embodiments, the element further comprises a material selected from the group consisting of thermal conductive polymer, polymer-metal composite, Ionic polymer metal composite, polymer matrix composite, and combinations thereof. In some of those embodiments, the material is in contact with the one more containers containing pre-lyophilization solution from a side wall, bottom, or both.

In certain embodiments the system further comprises a block or tube containing the one or more containers containing a pre-lyophilization solution. In certain of those embodiments, the block or tube is made up of metal-polymer composite, metal infused polymer, polymer or metal. In certain embodiments, the block or tube is in contact with the one more containers containing a pre-lyophilization solution from one or more of an outer wall or bottom.

In a fourth aspect, the invention provides a method of using the described system, wherein one or more of the containers are filled and/or half stoppered. The method comprises placing the one or more filled and/or half stoppered containers in a pocket of the element, placing the element on a tray or a moving belt, transferring the element to one of the plurality of shelves of the lyophilizer, removing the element after completion of a freeze-drying process, and taking the one or more containers out of the pocket.

In certain embodiments, where the element has radial groves within a pocket, a robotic filling line is used to place/fill a vial within a pocket.

In particularly preferred embodiments, the pocket is capable of accommodating a 2 mL to about 100 mL container, and the container is comprised of glass, plastic, or metal.

In a fifth aspect, the invention provides a modified USP type I glass container for a lyophilization process, the container comprising: a top having an opening extending to a bottom, a height, and a width.

In some embodiments, the height is shorter than the width and the bottom is flat.

In certain embodiments, the bottom has a hollow shape. In some of those embodiments, the hollow part consists of different shapes, such as but not limited to, cylinder, cone, and cylinder with a round surface at the end.

Such modified containers are easier to handle, have a greater surface area for heat transfer, and can be accommodated with robotic handling.

The invention also relates to a system for improving lyophilization process in a lyophilizer having a plurality of shelves that is able to reduce vial-to-vial variability in residual solvent after a lyophilization process. The system includes use of an element having one or more pockets, wherein the element is placed between a lyophilizer shelf and a sample container containing a pre-lyophilization solution. The element holds a container containing a pharmaceutical solution within a pocket during the lyophilization process.

In some embodiments, the element allows direct contact of at least one surface of the container with the lyophilizer shelf during the lyophilization process.

DETAILED DESCRIPTION

Presently described herein is an efficient solution for an overall improved lyophilization process with efficient heat transfer, less vial-to-vial variation in the drying process, less risk of product spillage during transfer, and tracking of individual vial position in the lyophilizer.

The term "lyophilization" (also known as freeze-drying, lyophilisation, or cryodesiccation) means a process of removal water or other solvents by freezing a material containing water and/or other solvents followed by reducing the surrounding pressure to allow the frozen water and/or other solvents in the material to sublimate directly from the solid phase to the gas phase.

As contemplated herein, unless otherwise noted, lyophilization is meant to involve three phases: freezing, primary drying, and secondary drying.

Lyophilization is performed within a lyophilizer. A variety of lyophilizers are commercially available and known in the art. The lyophilizer will have a lyophilizing chamber in which containers of product to be lyophilized are placed. The lyophilizing chamber contains one or more shelves on which the containers are placed. Typically, a plurality of shelves is used in the lyophilizing chamber during the lyophilization process.

The lyophilizer is used to remove solvent from a pharmaceutical product solution. As used herein, "product solution" is meant to refer to any liquid mixture containing one or more pharmaceutical solids and a pharmaceutically acceptable solvent. The solid may be fully dissolved or dispersed within the solvent.

Processes and apparatus for filling and loading vials into and out of a typical commercial, production-scale lyophilizer are described in. e.g., U.S. Pat. Nos. 9,522,752 and 10,781,003. It is envisioned that the elements, systems, and methods described herein may be used in conjunction with such processes and apparatus.

Figure 1:
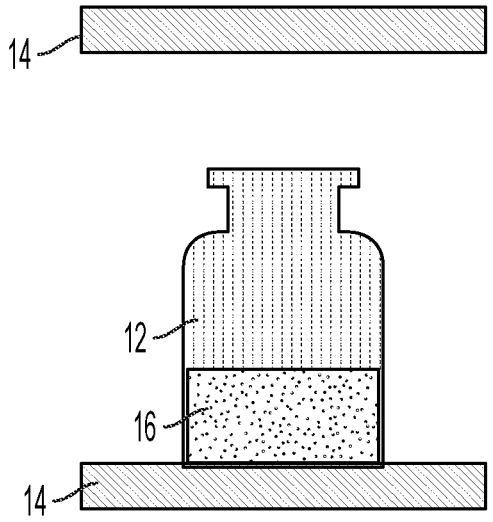
FIG. 1 shows a partial cross-sectional view from the side of a pharmaceutical vial loaded on the shelf of an exemplary, generally-known lyophilizer using methods known in the prior art.
Figure 2:
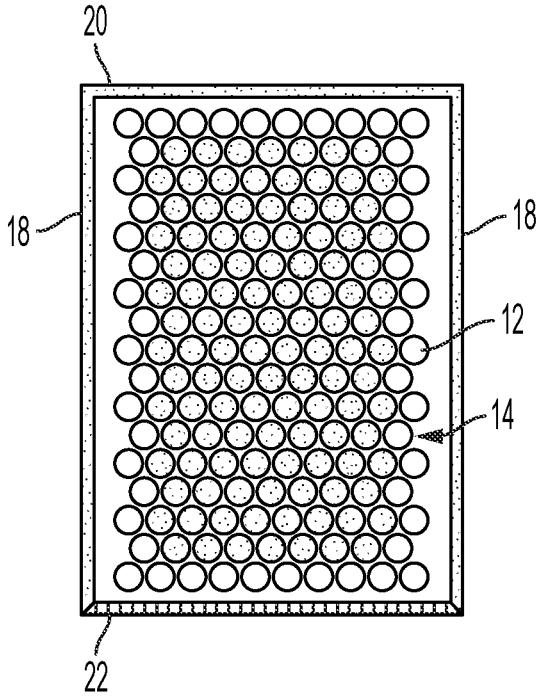
FIG. 2 shows a cross-sectional view from above of an exemplary, generally-known lyophilizer shelf filled with a plurality of vials using methods known in the prior art.

FIGS. 1 and 2 depict vials in a lyophilization process according to known methods. FIG. 1 depicts a single pharmaceutical container 12 placed upon a shelf 14 within the lyophilizer. The container 12 contains a product solution 16 intended to undergo the lyophilization process. As depicted in FIG. 2, a plurality of containers 12 are placed upon the shelf 14 in the lyophilizer, surrounded by side walls 18, a back wall 20, and a front door 22. Many lyophilizers employ several shelves 14 to hold a plurality of containers 12 each, and the containers 12 are also surrounded by an additional shelf 14 above accordingly, as depicted in FIG. 1, or by the top of the lyophilizer (not depicted).

To initiate the lyophilization process, the containers 12 are loaded into the lyophilizer upon the several shelves 14, and the door 22 to the lyophilizer is closed to create an enclosed space. The three steps of the lyophilization process are then performed—freezing, primary drying, and secondary drying—and the containers 12 are then removed from the lyophilizer and sealed for packaging and transport.

Figure 3A:
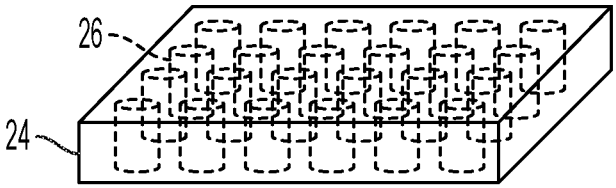
FIG. 3*a* shows a front perspective view of a lyophilization promoting element according to exemplary embodiments of the present invention.
Figure 3B:
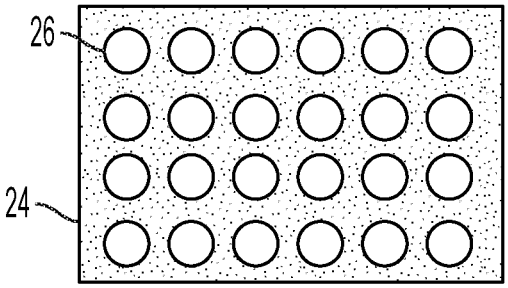
FIG. 3*b* shows an orthogonal view from above of a lyophilization promoting element according to exemplary embodiments of the present invention as depicted in FIG. 3*a*.
Figure 3C:
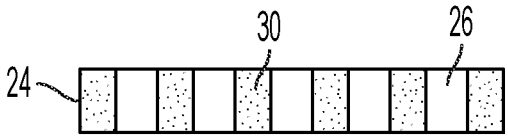
FIG. 3*c* shows a cross-sectional view from the side of a lyophilization promoting element according to exemplary embodiments of the present invention as depicted in FIGS. 3*a* and 3*b*.

The present invention improves upon the lyophilization process by encompassing the plurality of containers 12 with a lyophilization promoting element 24. As depicted in FIGS. 3*a*-3*c*, the element 24 includes one or more holes/openings or "pockets" 26 to accommodate each container 12 for lyophilization. The element is formed of a thermally conductive material having a thermal conductivity coefficient $\lambda$ of about 0.1 to about 400.0 [W/mK] at 20° C. at 1 bar and a co-efficient of linear thermal expansion $\alpha$ of about 1 to about 25 [$10^{-6}$° C.$^{-1}$] at normal temperature. The element is preferably made up of metal, most preferably aluminum ($\lambda$=239; $\alpha$=23) or an oxide of aluminum, although other suitable materials falling with these ranges can be found on pages 131 and 265 of the Mechanical Engineer's Data Handbook by James Carvill (Butterworth Heinemann 1993), the contents of which are incorporated herein by reference.

The height/depth of the pockets 26 may be about 5 mm to about 100 mm, or more preferably from about 10 mm to 80 mm and the width or diameter typically will be about 5 mm to about 30 mm, more preferably about 10 mm to about 25 mm. Most preferably, the height is about 20 mm to about 75 mm and diameter is about 15 mm to about 48 mm. Preferably, the pocket size is adapted to the size of container 12 and will allow a tolerance of about 0.05 mm to about 0.5 mm between the circumferential wall 30 of the pocket 26 and outer wall of container 12. The thickness of the element 24 is preferably about 10 mm to 200 mm, and more preferably between 20 mm and 100 mm. The area of the element 24 occupied by the pockets 26 is preferably more than 20% of total area when observed from above, more preferably more than 50%, and even more preferably more than 80%.

In some preferable embodiments, the pockets 26 extend through the entire thickness of the element 24 such that a bottom edge of the container 12 is visible and accessible when the container 12 is installed within the element 24. In other preferable embodiments, the pockets 26 extend only partially through the thickness of the element 24, creating a lower surface of the pockets 26 upon which the bottom edge of the containers 12 may rest when the containers are installed within the element 24. In preferable embodiments, the pockets 26 are sized to provide a snug fit for containers 12 contained therein such that the containers 12 do not fall through the element 24 when the element 24 is lifted, regardless of which preferable embodiment is used.

The container 12 will typically be a vial used to contain a liquid formulation and may be glass or glass-like vials or other suitably sterile transparent vials that are commercially available from various suppliers, including Nuova Ompi, Schott AG, or Daikyo Seiko, Ltd, for example. Pharmaceutical containers made from tubular glass are commercially available in a range of different sizes with dimensions according to the DIN/ISO 8362-1 standard. Molded glass vials are commercially available in a range of different sizes with dimensions according to the DIN/ISO 8362-4 standard. Particularly suitable glass containers are those described in 36 USP <660>/EP 3.2.1 Glass Containers for Pharmaceutical Use (2017). Glass has traditionally been the only choice for container material but problems with glass breakage, delamination, particulates due to glass-on-glass collisions, and stability of some products resulted in development and usage of suitable polymeric materials. One example of such polymeric material is TOPAS® cyclic olefin polymer. Vials made of polymeric materials are commercially available in size ranges and dimensions that typically closely mimic those of glass vials. Polymeric materials are significantly less scratch resistant than glass and existing aseptic processing equipment has not been redesigned to mitigate the risks of scratching. Scratched surfaces of containers are a serious concern for the perceived quality of the product, but also severely limits the inspection of the containers for particulates. Such inspection is typically a regulated requirement for good manufacturing practice. All such containers 12 are envisioned for use with the element 24. In some embodiments, the pocket 26 is adapted to contain a size 2R, 4R, 6R, 8R, 10R, 15R, 20R, 25R, 30R, 50R or 100R injection vial. The container 12 may further include a suitable stopper, such as commercially available elastomeric stoppers, e.g., those made or distributed by Daikyo Seiko, Ltd or West Pharmaceutical Services, Inc.

It is desirable that the pocket 26 have a depth that allows it to envelope the side wall portion of container 12 containing the solution 16 at least up to the height of the solution. In some embodiments, the pocket will have a depth sufficient to envelope 25%, more preferably 50% to 75% of the height (excluding neck) of a vial. In preferable embodiments, the depth of the pocket 26 is sufficient to surround the body of a vial but does not cover the vial neck. In certain embodiment, the depth of the pocket 26 is substantially similar to a height (excluding neck) of a standard size injection vial. In other embodiment, the depth of the pocket 26 is substantially similar to the height (including neck) of a vial.

In some embodiments, the element 24 of the present invention may be made up of polymeric material. The polymeric material can be hollow or filled with fluid having negative thermal expansion property, i.e., the fluid expands upon cooling, which can help to improve intimate contact of the element 24 and containers 12 placed within.

Figure 4A:
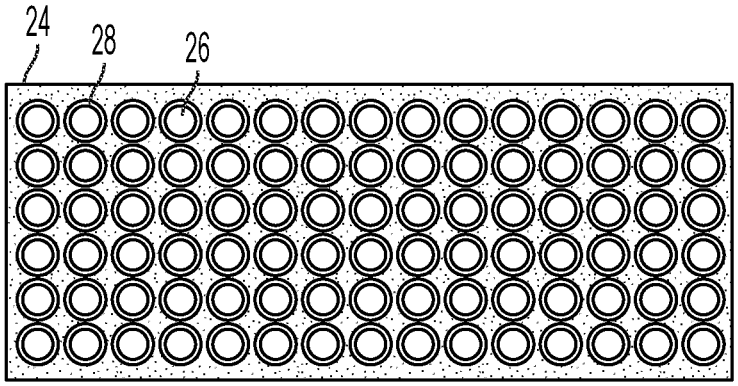
FIG. 4*a* shows an orthogonal view from above of a lyophilization promoting element according to exemplary embodiments of the present invention.

Referring now to FIG. 4*a*, depicted is a preferable embodiment of the lyophilization promoting element 24 with a plurality of pockets 26 arranged in a 6×15, standard spaced arrangement. As will be appreciated by those of skill in the art, a rectangular, 6×15 arrangement is just one example of how the pockets 26 may be arranged in the element 24, and other shapes, sizes, and spacings are likewise available and are included in this disclosure. For instance, commercially available trays typically have 60-120 containers, the quantity varying with vial diameter. It is envisioned that the number and arrangement of pockets 26 can match the vial configurations of commercially available trays as well as nests/supporting structures disclosed in, e.g., U.S. Pat. Nos. 9,522,752 and 10,781,003 and/or commercially available from known vial suppliers.

In the preferable embodiment depicted in FIG. 4*a*, the pockets 26 include a radial groove 28 extending outwardly from the outer circumference of the pockets 26. The radial groove 28 is cut out of the top surface of the element 24 and preferably extends radially and at a consistent angle from the top surface of the element, where the groove's 28 radius is largest, to the pocket's 26 outer circumference, where the groove's 28 radius is smallest and matches the pocket's 26 radius.

Figure 4B:
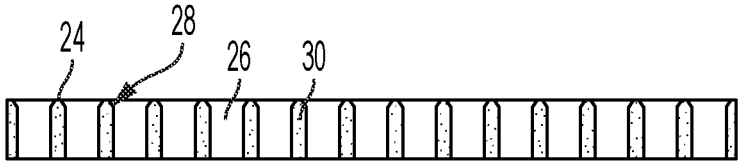
FIG. 4*b* shows a cross-sectional view from the side of a lyophilization promoting element according to exemplary embodiments of the present invention as depicted in FIG. 4*a*.
Figure 4C:
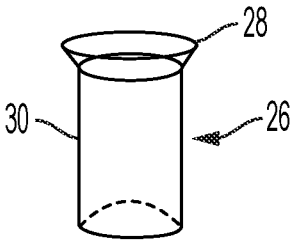
FIG. 4*c* shows a blown-up, front perspective view of a pocket of a lyophilization promoting element according to exemplary embodiments of the present invention as depicted in FIGS. 4*a* and 4*b*.

As depicted in FIGS. 4*b* and 4*c*, the radial groove's 28 angle is preferably between 30 and 60 degrees, and more preferably approximately 45 degrees. The radial grooves 28 extend from the top surface of the element 24 to a preferable depth of between 0.5 and 10 millimeters, and more preferably to a depth of approximately 2.5 to about 6.5 millimeters. The radial grooves 28 accommodate smooth placement of the containers 12 into element 24 from any direction.

Figure 5:
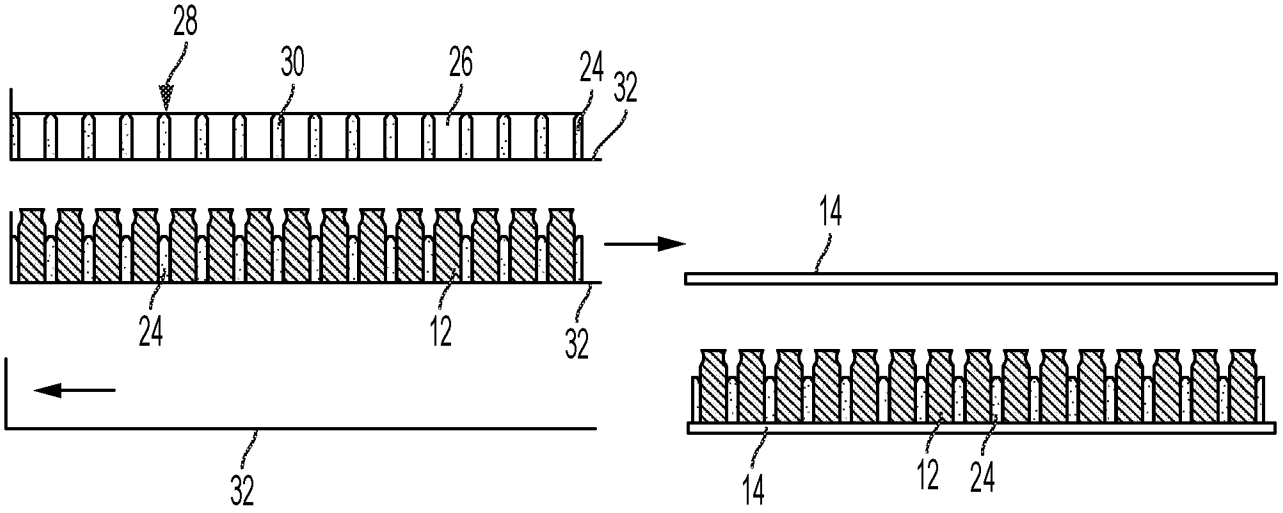
FIG. 5 shows a schematic depiction of the installation of a lyophilization promoting element onto a lyophilizer shelf for processing according to exemplary embodiments of the present invention.

FIG. 5 depicts the use of the preferable embodiment of the lyophilization promoting element 24 depicted in FIG. 4*a* to introduce a series of containers 12 into a lyophilizer. As depicted, the element 24 may be used in conjunction with a tray 32 to facilitate the installation and removal of the element 24 and containers 12 arranged therein. Containers 12 are first placed within the pockets 26 of element 24, with or without tray 32. The element 24 is then inserted into the lyophilizer and placed down upon the lyophilizer shelf 14. In preferable embodiments that use a tray 32, the tray 32 is then slid out from under the element 24 and containers 12 and removed from the lyophilizer while the element 24 and containers 12 remain resting on the lyophilizer shelf 14.

The lyophilization process then occurs, and the element 24 and containers 12 are removed from the lyophilizer once complete, either by sliding tray 32 between the element 24 and lyophilizer shelf 14 or by simply removing the element 24 with inserted containers 12 on its own where no tray 32 is employed. As noted, preferable embodiments of the lyophilization promoting element 24 employ pockets 26 sized to accommodate containers 12 snugly such that they remain removably held within the element 24 when the element 24 is being removed, manipulated, and/or transferred even in preferable embodiments in which the pockets 26 extend through the entire thickness of the element 24.

Referring next to FIG. 6, unique designs of pharmaceutical vial containers 12 are disclosed. Such unique containers 12, referred to herein as bottom-hollow containers 12, employ an internal bore 34 that extends up from the bottom edge of the container 12 into the container's interior 36. The internal bore 34 increases the contact surface area of the container's 12 outer surface and the lyophilization promoting element 24, improving the performance of heat transfer to and from the product solution 16 within the containers 12.

Figure 6A:
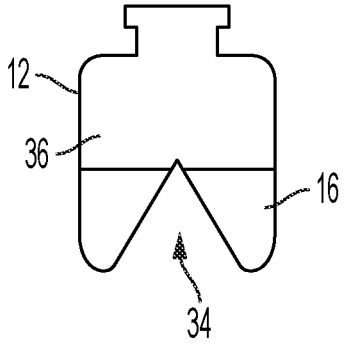
FIG. 6*a* shows a cross-sectional view from the side of a bottom hollow pharmaceutical vial container according to exemplary embodiments of the present invention.
Figure 6B:
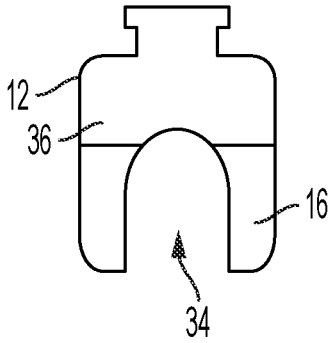
FIG. 6*b* shows a cross-sectional view from the side of a bottom hollow pharmaceutical vial container according to exemplary embodiments of the present invention.
Figure 6C:
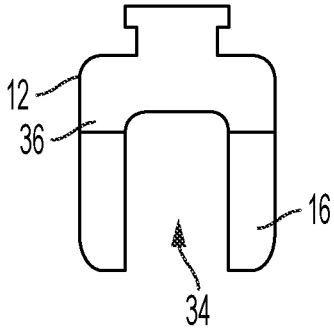
FIG. 6*c* shows a cross-sectional view from the side of a bottom hollow pharmaceutical vial container according to exemplary embodiments of the present invention.

Various shapes are available for the internal bore 34, including but not limited to those depicted in FIGS. 6*a*-6*c*—cone, cylinder, and cylinder with rounded top—among others. As those of skill in the art will appreciate, any internal bore 34 shape that increases the contact surface area between the container 12 and the element 24 will have the intended effect of increasing heat transfer to and from product solution 16.

Figure 7:
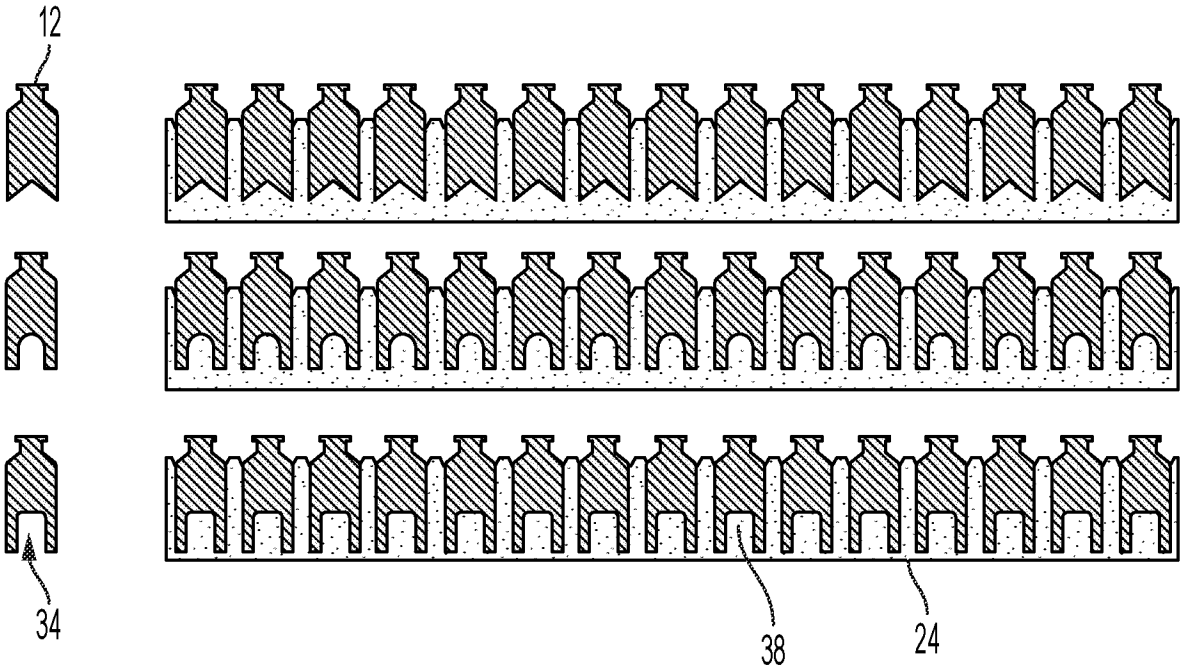
FIG. 7 shows a series of cross-sectional views from the side of lyophilization promoting elements according to exemplary embodiments of the present invention loaded with bottom hollow pharmaceutical vial containers according to exemplary embodiments of the present invention as depicted in FIGS. 6*a*-6*c*.
Figure 8:
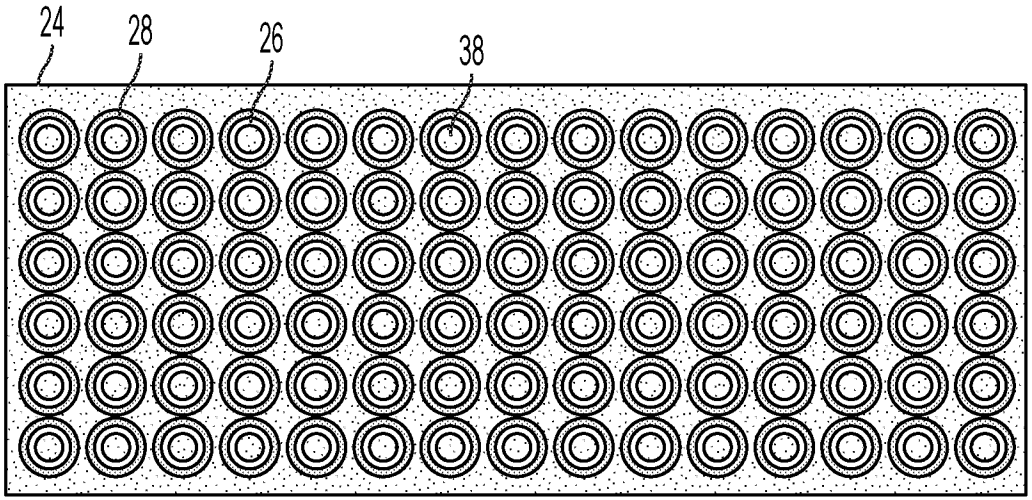
FIG. 8 shows an orthogonal view from above of a lyophilization promoting element according to exemplary embodiments of the present invention as depicted in FIG. 7.

Referring now to FIG. 7, the unique containers 12 from FIGS. 6*a*-6*c* are depicted in use with a preferable embodiment of the lyophilization promoting element 24, which employs a protrusion 38 extending from the lower end of the pocket 26 up into pocket 26 and is preferably shaped to match the internal bore 34 provided in the unique container 12 design. Notably, the protrusion's 38 shape need not perfectly or even closely match the internal bore's 34 shape, but a more closely matching shape between the internal bore 34 and protrusion 38 will increase the contact surface area between the container 12 and element 24, as those of skill in the art will recognize. FIG. 8 depicts a top down view of the preferable embodiment of element 24 from FIG. 7*c*, wherein the containers 12 have been removed, and visible is element 24 with a plurality of pockets 26 employing radial grooves 28 and protrusions 38.

Figure 9A:
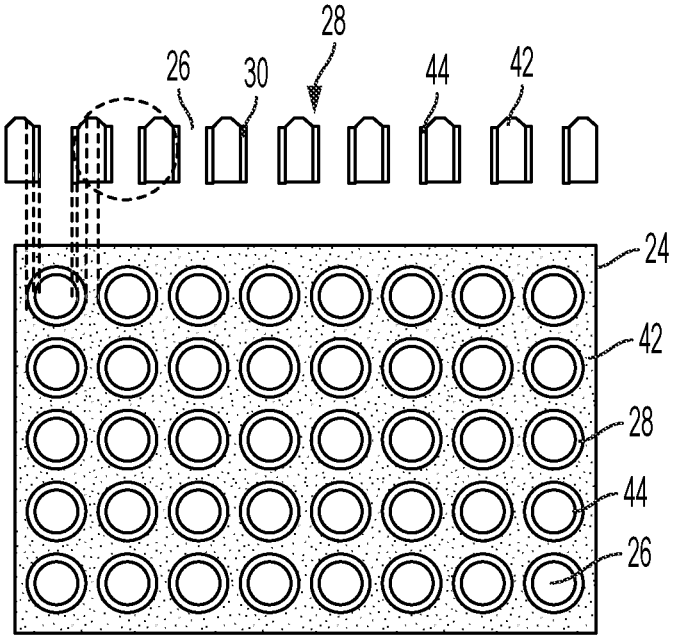
FIG. 9*a* shows a cross-sectional view from the side and an orthogonal view from above of a lyophilization promoting element according to exemplary embodiments of the present invention.
Figure 9B:
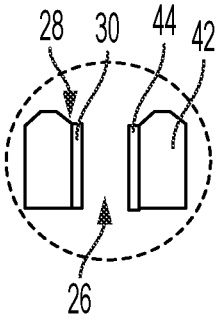
FIG. 9*b* shows a close-up, cross-sectional view from the side of a pocket of the lyophilization promoting element depicted in FIG. 9*a*.

Referring next to FIG. 9, depicted is a preferable embodiment of the lyophilization promoting element 24 with a primary portion 42 and a secondary portion 44. Such preferable embodiments preferably employ a first material for the primary portion 42, which makes up the vast majority of element 24, and a second material for the secondary portion 44, which is present only directly adjacent to the circumferential wall 30 of one or more of the pockets 26. By adding a secondary portion 44 comprising a second material directly adjacent to the circumferential wall 30 of pockets 26 (and thus to the containers 12 when installed), more costly materials more effective at direct conduction heat transfer may be employed efficiently and only where most effective, while the remaining primary portion 42 of the element 24 may be made of another, less costly material. Such preferable embodiments help to maximize the efficiency of heat transfer between the lyophilizer and the product solution 16 within the containers 12 during the lyophilization process.

Figure 10:
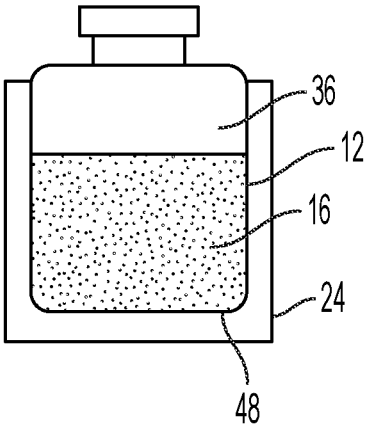
FIG. 10 shows a cross-sectional view of a pharmaceutical vial container within a pocket of a lyophilization promoting element according to exemplary embodiments of the present invention.
Figure 11:
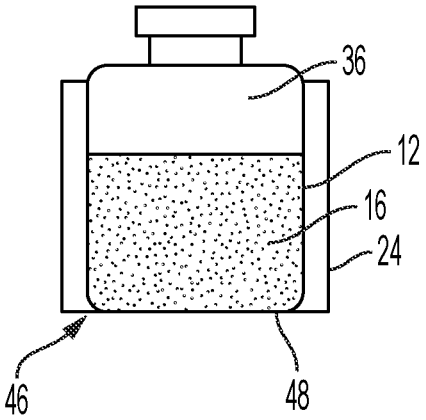
FIG. 11 shows a cross-sectional view of a pharmaceutical vial container within a pocket of a lyophilization promoting element according to exemplary embodiments of the present invention.

Referring now to FIGS. 10-13, a series of containers 12 containing product solutions 16 installed within preferable embodiments of lyophilization promoting elements 24 are depicted. FIG. 10 depicts a container 12 in element 24 with pocket 26 that does not extend through the entire thickness of element 24, thereby creating a lower surface of pocket 26 upon which container 12 rests. FIG. 11 depicts a similar arrangement, however the pocket 26 depicted in FIG. 11 does extend through the entire thickness of element 24, permitting access of the lyophilizer shelf to the bottom 48 of the container 12.

Notably, while some preferable embodiments of the element 24 employ a plurality of pockets 26 all of which either extend entirely through the element's 24 thickness or do not, other embodiments may employ a plurality of both. In other words, some embodiments of the element 24 may include a plurality of pockets 26 that extend through the entire thickness of the element and a plurality of pockets 26 that do not, or any combination thereof, as those of skill in the art will appreciate.

Figure 12:
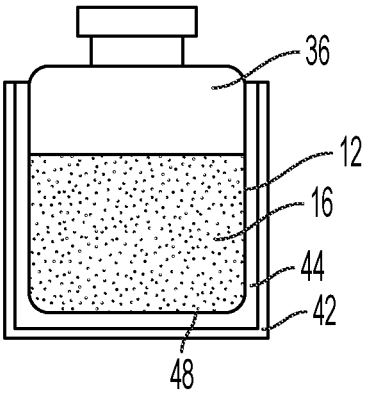
FIG. 12 shows a cross-sectional view of a pharmaceutical vial container within a pocket of a lyophilization promoting element according to exemplary embodiments of the present invention.
Figure 13:
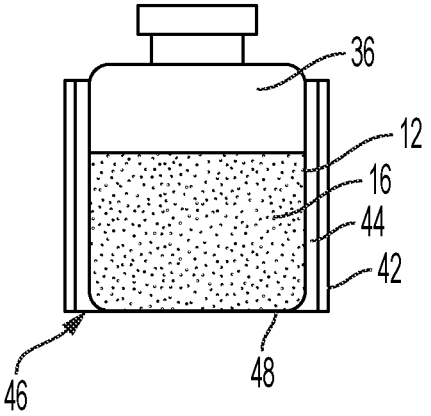
FIG. 13 shows a cross-sectional view of a pharmaceutical vial container within a pocket of a lyophilization promoting element according to exemplary embodiments of the present invention.

FIGS. 12 and 13 are similar to FIGS. 10 and 11, respectively, but also depict secondary portion 44 of element 24 comprising a second material directly adjacent to the installed containers 12. As noted with respect to FIG. 9, the secondary portion may be utilized to improve the efficiency of heat transfer between the lyophilizer and the product solution 16 within the containers 12 during the lyophilization process. With respect to FIGS. 11 and 13 specifically, depicted are lyophilization promoting elements 24 with pockets 26 extending through the elements' 24 entire thickness. This is notable because, as discussed above, element 24 is intended to facilitate moving the containers 12 as a group, and the containers 12 must accordingly fit snugly within pockets 26 to avoid dropping out of the bottom of elements 24 when the pockets 26 extend the entire length of the elements 24.

Furthermore, in the preferable embodiments of the element 24 depicted in FIGS. 11 and 13, the pockets 26 employ a radial ridge 46 extending from the lower edge of the element 24 into the pockets 26. This radial ridge 46 is preferably sized and shaped to support the containers 12 from below when they are installed in the element 24. As depicted, the radial ridge 46 preferably extends at an angle from the lower edge of the element 24, at which point the radial ridge extends furthest into pocket 26, up into the pocket 26 a short distance, wherein it meets the circumferential wall 30 of the pocket 26. The radial ridge's 46 angle is preferably between 30 and 60 degrees, and more preferably approximately 45 degrees. The radial ridge 46 preferably extends no further than 0.5 millimeters to 6 millimeters from the element's 24 lower edge up into the pocket 26, and more preferably extends to a height of approximately 1.5 millimeters to 4 millimeters. Whatever the arrangement of radial ridge 46, the bottom 48 of the container 12 should preferably sit flush with or protrude slightly below the lower edge of the element 24, as depicted in FIGS. 11 and 13.

In some preferable embodiments, the pockets 26 have side channels to permit air displacement while inserting the containers 12 into the pockets 26. The side channel feature is particularly useful in preferable embodiments in which the pockets 26 do not extend through the entire thickness of the element 24, creating a lower surface of the pockets 26 upon which the bottom 48 of the containers 12 may rest when the containers 12 are installed within the element 24. Such side channels preferably have a width of about 1% to 10% of the total perimeter of the pockets 26. The side channels may be cylindrical or cubical or any other shape that can assist with the passage of air, as will be understood by those of skill in the art.

In some embodiments, the pockets 26 are numbered by engraving, printing, or embossing to locate the position of a container 12 on the shelf before lyophilization, and also after lyophilization. Such numbering can help in sampling or investigation.

Figure 14A:
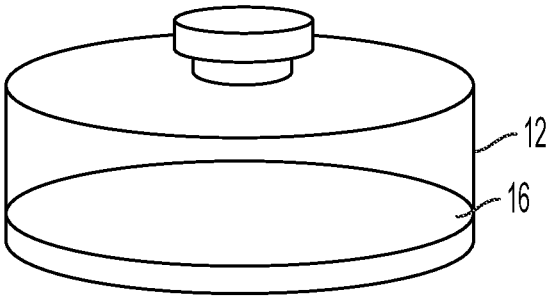
FIG. 14*a* shows a front perspective view of a flat-bottom, short height pharmaceutical vial container according to exemplary embodiments of the present invention.
Figure 14B:
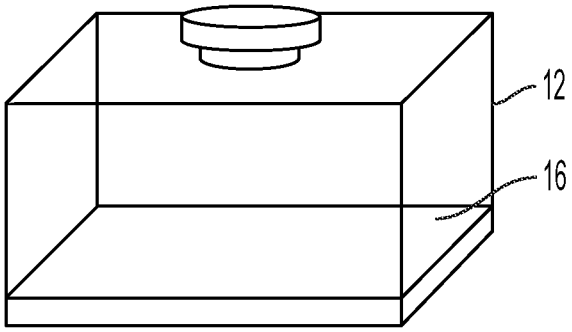
FIG. 14*b* shows a front perspective view of a flat-bottom, short height pharmaceutical vial container according to exemplary embodiments of the present invention.

Referring lastly to FIG. 14, depicted are unique designs for pharmaceutical vial containers 12, referred to herein as flat-bottom, short-height containers 12. Such flat-bottom, short height containers 12 improve the effective heat transfer between the lyophilizer and the product solution 16 by increasing the contact surface area between the container 12 and the element 24 or the lyophilizer shelf 14, similar to the advantages provided by the bottom-hollow containers 12 depicted in FIGS. 6-7. Because the flat-bottom, short-height containers 12 have a large bottom surface area, the product solution 16 is more spread out and more effectively subjected to direct conduction heat transfer. Preferable embodiments of the flat-bottom, short height containers 12 may be used in conjunction with preferable embodiments of the lyophilization promoting elements 24 or may be placed directly upon the lyophilizer shelf 14 without losing any significant heat transfer effectiveness.

While the present invention has been described with reference to particular embodiments and arrangements of parts, features, and the like, it is not limited to these embodiments or arrangements. Indeed, modifications and variations will be ascertainable to those of skill in the art, all of which are inferentially and inherently included in these teachings.

What is claimed is:

1. A lyophilization promoting element comprising:

a base plate comprising a plurality of apertures;

the base plate comprising a thermally conductive material;

the apertures being regularly arranged within the base plate, and each aperture being sized to receive a pharmaceutical vial container containing a pre-lyophilization solution;

wherein the lyophilization promoting element facilitates a transfer of heat between a lyophilizer and the pre-lyophilization solution, and wherein the base plate comprises a hollow polymeric material and a fluid with a negative thermal expansion property.

2. The lyophilization promoting element of claim 1, wherein the base plate comprises aluminum or an oxide of aluminum.

3. The lyophilization promoting element of claim 1, wherein each of the plurality of apertures is cylindrical and has a diameter between 5 and 100 millimeters.

4. The lyophilization promoting element of claim 1, wherein each of the plurality of apertures comprises a circumferential wall and is sized to allow a tolerance of no more than 0.5 millimeters between the circumferential wall and an outer wall of an inserted pharmaceutical vial container.

5. The lyophilization promoting element of claim 1, wherein the base plate has a vertical thickness between 10 and 200 millimeters.

6. The lyophilization promoting element of claim 1, wherein the base plate comprises a surface area and the plurality of apertures occupy more than 50% of the surface area.

7. The lyophilization promoting element of claim 1, wherein at least one of the plurality of apertures extends entirely through a vertical thickness of the base plate.

8. The lyophilization promoting element of claim 1, wherein at least one of the plurality of apertures extends only partially through a vertical thickness of the base plate.

9. The lyophilization promoting element of claim 1, wherein each of the plurality of apertures further comprises a radial groove, the radial groove expanding outwardly from a circumferential wall of each aperture adjacent to a top surface of the base plate.

10. The lyophilization promoting element of claim 9, wherein each radial groove extends at an angle of approximately 45 degrees to a depth of approximately 0.5 to 10 millimeters from the top surface of the base plate down to the circumferential wall of each aperture.

11. A lyophilization promoting element comprising:

a base plate comprising a plurality of apertures;

the base plate comprising a thermally conductive material;

the apertures being regularly arranged within the base plate, and each aperture being sized to receive a pharmaceutical vial container containing a pre-lyophilization solution;

wherein the lyophilization promoting element facilitates a transfer of heat between a lyophilizer and the pre-lyophilization solution;

wherein each of the plurality of apertures extends only partially through a vertical thickness of the base plate and the base plate further comprises a plurality of protrusions extending up from the base plate into each of the plurality of apertures.

12. The lyophilization promoting element of claim 11, wherein the base plate comprises a thermally conductive material with a thermal conductivity coefficient $\lambda$ of about 0.1 to about 400.0 [W/mK] at 20° C. at 1 bar and a co-efficient of linear thermal expansion $\alpha$ of about 1 to about 25 [$10^{-6}$° C.$^{-1}$] at normal temperature.

13. The lyophilization promoting element of claim 11, wherein the protrusions are sized and shaped to match an internal bore provided in a bottom of an inserted pharmaceutical vial container, said internal bore extending upwardly into an interior of said inserted pharmaceutical vial container.

14. The lyophilization promoting element of claim 1, wherein the base plate comprises a first portion comprised of a primary material and a second portion comprised of a secondary material, the second portion being located adjacent to a circumferential wall of each of the plurality of apertures.

15. The lyophilization promoting element of claim 1, wherein each of the plurality of apertures extends entirely through a vertical thickness of the base plate and further comprises a radial ridge, the radial ridge extending inwardly from a circumferential wall of each aperture adjacent to a bottom surface of the base plate.

16. The lyophilization promoting element of claim 15, wherein each radial ridge extends at an angle of approximately 45 degrees to a height of approximately 0.5 to 6 millimeters from the bottom surface of the base plate up into each aperture to meet the circumferential wall of each aperture.

17. The lyophilization promoting element of claim 1, wherein each of the plurality of apertures further comprises at least one side channel that permits the passage of air, said side channel having a width no greater than 10% of a perimeter of the aperture.

18. A method of lyophilization comprising steps of:

providing a lyophilization promoting element comprising:

a base plate comprising a plurality of apertures, the base plate comprising a thermally conductive material;

the apertures being regularly arranged within the base plate;

wherein the lyophilization promoting element facilitates the transfer of heat between a lyophilizer and the pre-lyophilization solution;

providing one or more pharmaceutical vial containers containing a pre-lyophilization solution, the one or more pharmaceutical vial containers being half stoppered;

inserting the one or more pharmaceutical vial containers into the plurality of apertures of the lyophilization promoting element;

providing a tray;

placing the lyophilization promoting element holding the one or more pharmaceutical vial containers on the tray;

placing the tray and the lyophilization promoting element holding the one or more pharmaceutical vial containers on the shelf of the lyophilizer;

removing the tray from between the shelf of the lyophilizer and the lyophilization promoting element, leaving the lyophilization promoting element holding the one or more pharmaceutical vial containers on the shelf of the lyophilizer;

closing a door to the lyophilizer and initiating the lyophilization process, said lyophilization process comprising the steps of freezing, primary drying, and secondary drying;

reinserting the tray between the lyophilizer shelf and the lyophilization promoting element and removing the tray and the lyophilization promoting element holding the one or more pharmaceutical vial containers from the lyophilizer upon completion of the lyophilization process; and fully stoppering and sealing the one or more pharmaceutical vial containers.

* * * * *